US012187517B2

(12) United States Patent
Bischoff et al.

(10) Patent No.: US 12,187,517 B2
(45) Date of Patent: Jan. 7, 2025

(54) PALLET CONTAINER

(71) Applicant: MAUSER-WERKE GMBH, Bruehl (DE)

(72) Inventors: Sebastian Bischoff, Niederkassel (DE); Markus Meyer, Nideggen-Schmidt (DE); Klaus-Peter Schmidt, Bonn (DE)

(73) Assignee: Mauser Werke GmbH (DE)

( * ) Notice: Subject to any disclaimer, the term of this patent is extended or adjusted under 35 U.S.C. 154(b) by 0 days.

(21) Appl. No.: 17/768,739

(22) PCT Filed: Oct. 16, 2020

(86) PCT No.: PCT/EP2020/000179

§ 371 (c)(1),
(2) Date: Apr. 13, 2022

(87) PCT Pub. No.: WO2021/073767

PCT Pub. Date: Apr. 22, 2021

(65) Prior Publication Data

US 2024/0140674 A1 May 2, 2024

(30) Foreign Application Priority Data

Oct. 18, 2019 (DE) ..... 202019004316.0
Dec. 5, 2019 (DE) ..... 202019004962.2

(51) Int. Cl.
*B65D 77/04* (2006.01)
*B65D 19/10* (2006.01)
(Continued)

(52) U.S. Cl.
CPC ..... *B65D 77/0466* (2013.01); *B65D 19/10* (2013.01); *B65D 19/18* (2013.01);
(Continued)

(58) Field of Classification Search
CPC ..... B65D 2519/00512; B65D 19/10; B65D 77/0466; B65D 1/48; B65D 19/385; B65D 2519/00164
See application file for complete search history.

(56) References Cited

U.S. PATENT DOCUMENTS

2016/0376059 A1 12/2016 Sengelin

FOREIGN PATENT DOCUMENTS

| | | | |
|---|---|---|---|
| DE | 4425630 | A1 | 10/1995 |
| WO | 2004096660 | A1 | 11/2004 |
| WO | 2012085940 | A2 | 6/2012 |

OTHER PUBLICATIONS

International Search Report, dated Feb. 12, 2021 in corresponding International Application No. PCT/EP2020/000179.

*Primary Examiner* — Anthony D Stashick
*Assistant Examiner* — L Kmet
(74) *Attorney, Agent, or Firm* — Morris, Manning & Martin, LLP; Daniel E. Sineway, Esq.

(57) ABSTRACT

The present invention describes a pallet container (10) for storing and transporting fluid or flowable filling materials, having a thin-walled, rigid plastics inner container (12) made from thermoplastic plastics material, having a tubular grid frame (14) which tightly surrounds the plastics inner container (12) as a supporting covering and which comprises horizontal and vertical tubular rods (18, 20) which are welded to each other, and having a base pallet (16) on which the plastics inner container (12) is positioned and to which the tubular grid frame (14) is securely connected, wherein at least two rod-shaped transverse cross-members (22) are provided above the plastics inner container (12) and are fixed with the two ends thereof to two mutually opposite side walls in the upper region of the tubular grid frame (14).
In order to protect the upper region of the tubular grid frame (14) against a disadvantageous effect of impact loads and
(Continued)

transport impacts, there is provision for the transverse cross-members (22) to be constructed as resilient spring elements (24).

16 Claims, 5 Drawing Sheets

(51) Int. Cl.
*B65D 19/18* (2006.01)
*B65D 19/38* (2006.01)

(52) U.S. Cl.
CPC .. *B65D 19/385* (2013.01); *B65D 2519/00009* (2013.01); *B65D 2519/00164* (2013.01); *B65D 2519/00512* (2013.01); *B65D 2519/00532* (2013.01); *B65D 2519/00547* (2013.01)

PALLET CONTAINER

CROSS REFERENCE TO RELATED APPLICATIONS

This application is a national phase of PCT application No. PCT/EP2020/000179, filed Oct. 16, 2020, which claims priority to DE patent application No. 202019004316.0, filed Oct. 18, 2019, and DE patent application No. 202019004962.2, filed Dec. 5, 2019, all of which are incorporated herein by reference thereto.

BACKGROUND OF THE INVENTION

The present invention relates to a pallet container for storing and transporting fluid or flowable filling materials, having a thin-walled, rigid inner container made from thermoplastic plastics material, having a tubular grid frame which tightly surrounds the plastics inner container as a supporting covering and which comprises horizontal and vertical tubular rods which are welded to each other, and having a base pallet on which the plastics inner container is positioned and to which the tubular grid frame is securely connected, wherein two rod-shaped transverse cross-members are provided above the plastics inner container and are fixed with the two ends thereof to two mutually opposite side walls in the upper region of the tubular grid frame. The rod-like transverse cross-members are intended to prevent excessive bulging of the plastics inner container or the upper base thereof with a central screw cap, in particular in the event of transport impacts and dynamic vibrations, and also serve inter alia, in the event of an undesirable overturning of the pallet container, to retain the plastics inner container in the tubular grid frame on the base pallet and to prevent it from sliding out of the tubular grid frame. In order to allow a simple exchange of the plastics inner container for multiple uses of the pallet container, the transverse cross-members are releasably secured with the two ends thereof in the upper region of the tubular grid frame, generally screwed. Such a pallet container having two transverse cross-members extending parallel is known, for example, from the publication WO 2012085940 A2. In a pallet container which is described in the publication DE 4425630 A1, exactly four transverse cross-members are provided, wherein two transverse cross-members which obliquely intersect with each other cover one half of the plastics inner container, respectively.

Problem:

When pallet containers are intended to be used for storing and transporting hazardous liquid filling materials, such as, for example, aggressive chemicals, these pallet containers then require a so-called hazardous goods approval of an official national inspection body, in Germany this is the BAM (Federal Institute for Materials Research and Testing). In order to obtain such a hazardous goods approval, the various types of pallet containers are subjected to a specific construction type testing with various loading states, such as, for example, an internal pressure test, drop test and vibration test. During the vibration test, significant transport loads (impacts, shocks) are simulated on a filled pallet container. In this instance, the liquid column in the plastics inner container can be subjected to significant dynamic vibrations. These vibrations cause powerful alternating loads on the side walls of the plastics inner container and are transmitted directly to the tubular grid frame which tightly surrounds the plastics inner container as a supporting covering. Since a pallet container generally has two longer and two shorter side walls, the two longer opposing side walls are generally subjected to higher loads and are therefore stabilized by the engaging transverse cross-members. The upper base of the plastics inner container also carries out significant dynamic upward and downward vibrations which act on the transverse cross-members. In the event of a bulging of the upper base in an upward direction, the known straight transverse cross-members which extend parallel with each other are pressed upward and significant tensile loads act on the two fixing locations of the transverse cross-members on the tubular grid frame between the mutually opposing side walls of the tubular grid frame, whereby the upper region of the tubular grid frame is pulled inward. When the upper base is lowered, the opposing side walls of the plastics inner container and of the tubular grid frame bulge outward, wherein the upper region of the tubular grid frame is also pressed outward. In this instance, the transverse cross-members with the two fixing locations thereof are again subjected to a significant tensile loading. This alternating loading is repeated at high frequency over a relatively long period of time and has a wearing effect on the corresponding components of a pallet container.

Objective:

An objective of the present invention is to reduce these disadvantageous tensile stresses and to absorb the effect of tensile loads on the fixing locations of the transverse cross-members and accordingly on the upper region of the tubular grid frame and to mitigate tension peaks.

Solution

SUMMARY OF THE INVENTION

The intended reduction of disadvantageous tensile stresses is achieved in that the two rod-like transverse cross-members are constructed as resilient spring elements. As a result of the resilient construction of the two transverse cross-members as spring elements, the rigid connection of previously conventional transverse cross-members which extend in a linear straight manner to the opposing side walls of the tubular grid frame is eliminated and a limited resilience is "incorporated" into the upper plane of the tubular grid frame. In the event of a bulging of the upper base in an upward direction, the tensile forces which occur on the two fixing locations of the transverse cross-members are reduced and the upper region of the tubular grid frame is pulled inward to a lesser extent. In the event of a lateral bulging of the plastics inner container and the associated bulging of the opposing side walls of the tubular grid frame in an outward direction, the tensile forces which occur in the upper region of the tubular grid frame are significantly reduced as a result of the transverse cross-members which are constructed as resilient spring elements and the operational safety of filled pallet containers in the event of dynamic transport loads is significantly increased.

According to the present invention, the transverse cross-members which are constructed as resilient spring elements are not formed so as to extend in a linear manner, but instead to have one or more curved portions. In this instance, the actual length of the transverse cross-members between their two fixing locations is constructed to be greater than the direct spacing of the two fixing locations at the ends of the transverse cross-members in the upper region of the tubular grid frame. As a result of this structural configuration, the transverse cross-members are, on the one hand, in the event of tensile loading —when the tubular grid frame bulges outward —flexible in their horizontal longitudinal direction, on the other hand, even in the event of lateral pressure loading—as a result of a bulging of the upper base of the plastics inner container in an upward direction—they are configured to be flexible in a vertical direction.

This is achieved in an embodiment of the invention by the transverse cross-members being constructed between their two fixing locations so as not to extend in a linear manner, but instead in a curved manner, and to have a comparatively large curve.

In a preferred embodiment, the construction of the two transverse cross-members as resilient spring elements is achieved aby an arcuately curved form having a large shaped curve. In this instance, the transverse cross-members—when viewed in the fitted state—are bent in the horizontal plane, wherein the curves each have a comparatively large radius and are directed outward in the direction of the two opposing shorter side walls of the tubular grid frame. In the fitted state, the arcuately curved transverse cross-members are consequently positioned flat on the upper base of the plastics inner container, wherein the curves of the two transverse cross-members are orientated so as to be directed away from each other.

Advantageously, the two transverse cross-members extend through a retaining device in the form of a closed retaining lug which is formed from the upper base of the plastics inner container. In modified form, the retaining devices formed from the upper base of the plastics inner container may also be constructed as carrier pins which are open at one side. In the following, these carrier pins which are open at one side are also referred to below as hook lugs.

The closed retaining lugs or the carrier pins which are open at one side are arranged laterally adjacent the central filling opening of the plastics inner container which can be closed by means of a screw cap, and the center of the curve of the two transverse cross-members is located precisely below a retaining lug or below a carrier pin. The transverse cross-members with their arcuately curved shape can, on the one hand, in the event of a bulging of the upper base in an upward direction and in a downward direction—for example, also in the event of an internal pressure test or drop test—yield resiliently in a vertical direction and adapt to the bulge, they virtually "follow" the shape of the upper base.

In another embodiment of the invention, the transverse cross-members in the form of resilient spring elements may also be provided with two or three smaller curves with comparatively smaller radii.

The fixing locations of the arcuately curved transverse cross-members are—in comparison with previously conventional straight transverse cross-members—displaced further to the center of the upper region of the tubular grid frame, at locations where the largest bulges with the largest tensile loads occur and are intended to be absorbed.

During the vibration test, the arcuately curved transverse cross-member acts as a resilient spring. During the vibration, the upper base of the inner container vibrates up and down. In their upper and lower end points, these vibrations cause a resilient upward and downward bending of the previously conventionally linear transverse cross-members which is converted directly into a reduction of the spacing between the fixing locations. As a result of this reduction of the spacing, the tubular grid frame is significantly drawn inward in the upper region with each travel. With the new "spring solution" which is also flexible in a longitudinal direction, however, a substantially reduced deformation and therefore a reduced loading on the pallet container are achieved at the upper edge of the tubular grid frame.

In order to obtain optimum resilience and spring-like action of the transverse cross-members, the length of the transverse cross-members is constructed according to their line of curvature between their two fixing locations to be between 1% and 5% greater than the direct spacing (corresponding to a chord) between the two fixing locations. The size of the curve and the arcuately curved shape of the transverse cross-members is thereby brought about as a resilient spring element.

In a preferred embodiment of the invention, the two ends of the transverse cross-members are strongly compressed in the radial direction, a corresponding internal thread, for example, M8, is directly formed in the compressed portions and the two ends of the transverse cross-members are securely screwed with their end face to an upper horizontal or vertical tubular rod of the tubular grid frame. In this embodiment, the two ends of the transverse cross-members are each screwed with their. end face to the upper end of two adjacent vertical tubular rods.

In another embodiment of the invention, a threaded nut having an internal thread is inserted in a secure manner at the end face in both ends of the transverse cross-members and the transverse cross-members are screwed in a secure manner with their respective end faces—so to speak, in the axial direction—to an upper horizontal or vertical tubular rod of the tubular grid frame. In this instance, the threaded nut which is inserted in a secure and non-releasable manner into the transverse cross-member which is constructed as a hollow tubular profile, can be simply pressed in, compressed or welded.

BRIEF DESCRIPTION OF THE DRAWING

The invention is explained and described in greater detail below with reference to embodiments which are illustrated in the drawings, in which.

DETAILED DESCRIPTION OF PREFERRED EMBODIMENTS

Figure 1:
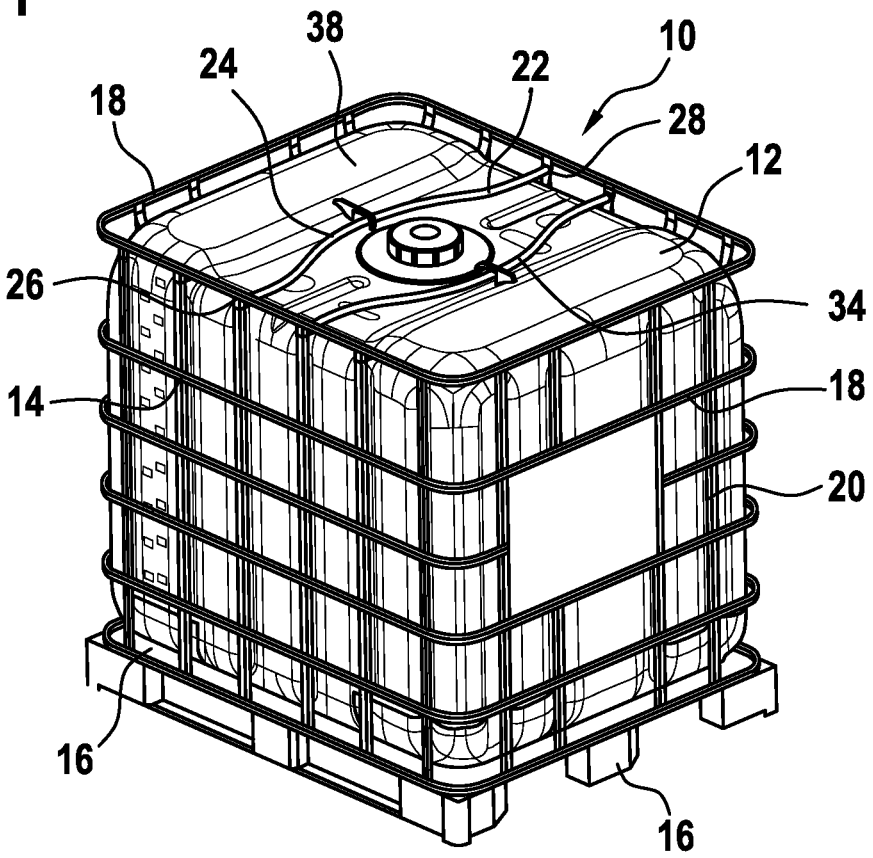
FIG. 1 is a perspective view of a pallet container according to the invention.

FIG. 1 illustrates a pallet container 10 according to the invention (also referred to as an "IBC"=Intermediate Bulk Container) for storing and transporting fluid or flowable filling materials. The pallet container 10 comprises a thin-walled, rigid plastics inner container 12 made from thermoplastic plastics material, a tubular grid frame 14 which tightly surrounds the plastics inner container 12 as a supporting covering and which comprises horizontal and vertical tubular rods 18, 20 which are welded to each other and a base pallet 16 on which the plastics inner container 12 is positioned and to which the tubular grid frame 14 is securely connected. Two rod-shaped transverse cross-members 22 are provided above the plastics inner container 12 and are fixed with the two ends thereof to two mutually opposite side walls of the upper tubular grid frame 14. In this case, the two transverse cross-members 22 are in the form of resilient spring elements 24 in an arcuately curved form. The particular constructive embodiment of the transverse cross-members 22 is distinguished in that the transverse cross-members are constructed not to be rectilinear or linear between the two fixing locations 26, 28 thereof, but instead in a curved manner and have a comparatively large curve 34. In this case, the length of the transverse cross-members 22 between their two fixing locations 26, 28 is constructed in a completely unusual manner to be greater than the direct spacing of the two fixing locations 26, 28 at the ends of the transverse cross-members 22. In the present embodiment, the fixing locations 26, 28 are arranged at the ends of the transverse cross-members 22 in each case on two vertical rods closely below the uppermost horizontally extending tubular rod 18 between two opposing side walls of the tubular grid frame 14.

Specifically, the length of the transverse cross-members 22 between their two fixing locations 26, 28 is constructed to be between 1% and 5%, preferably 3% greater than the direct spacing between the two fixing locations 26, 28. For standard pallet containers having a filling volume of 600, 1000 or 1200 liters and which have the same dimension in terms of width and length, the spacing of the two fixing locations 26, 28 from each other is approximately 960 mm and the effective length of the transverse cross-members 22 is approximately 993 mm. For the same standard pallet containers, the curved transverse cross-members 22 are intended to have a large radius of curvature between 300 mm and 700 mm, preferably 500 mm.

Figure 2:
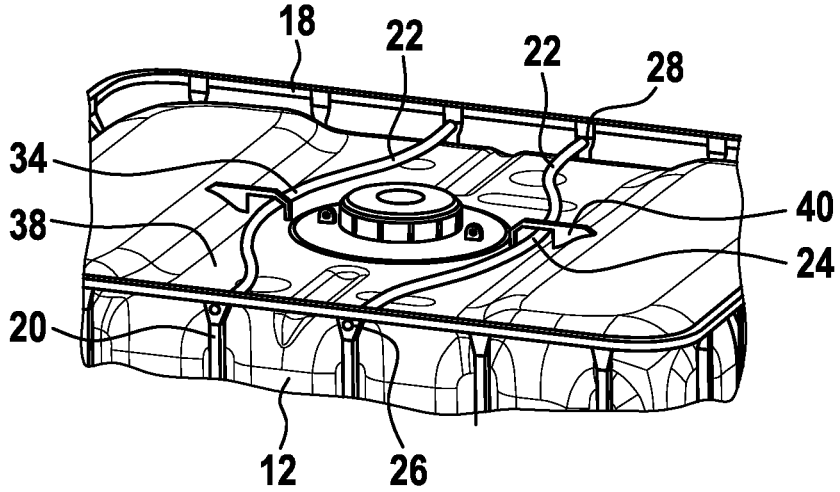
FIG. 2 is an enlarged partial view of the upper region of the pallet container according to the invention according to FIG. 1.

The above-described constructive embodiment of the invention can be better seen in FIG. 2 in an enlarged cut-out. In this case, it is shown that the arcuately curved transverse cross-members 22—in the fitted state—are positioned flat in a horizontal plane on the upper base 38 of the plastics inner container 12, wherein the large curves 34 of the two transverse cross-members 22 are orientated so as to face away from each other.

In a modified embodiment, the transverse cross-members 22 can be constructed as resilient spring elements with two or three smaller curves which are orientated in a horizontal plane and which have smaller radii in comparison.

Figure 9:
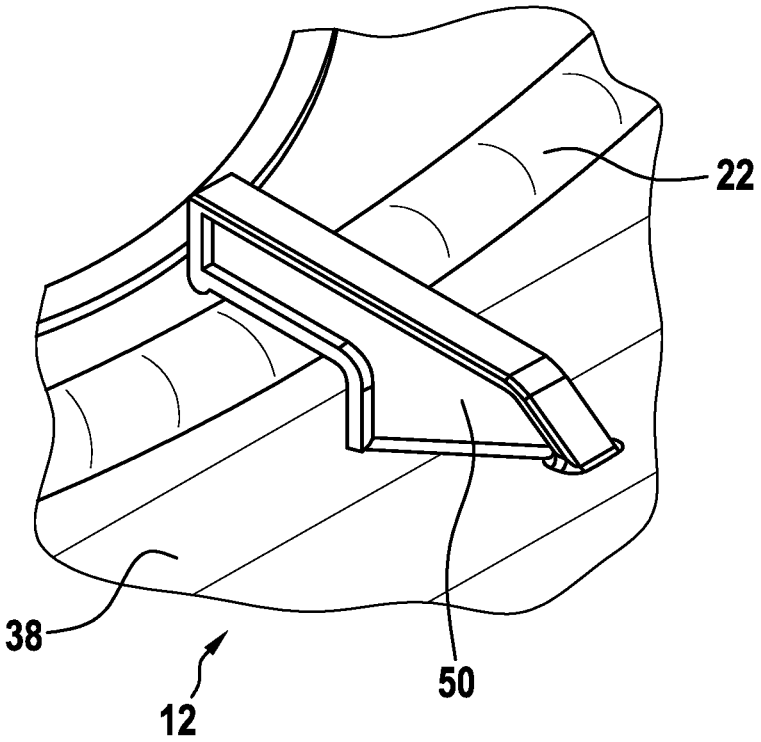
FIG. 9 is a partial view of a hook lug (carrier pin) which is formed from the upper base of the plastics inner container and which engages over a transverse cross-member and FIG. 10 is an enlarged partial cross sectional view with a conventional connection of a transverse cross-member to the upper region of the tubular grid frame.

In any case, the arcuately curved transverse cross-members 22—in the installed state—are each guided through a retaining lug 40 which is formed from the upper base 38 of the plastics inner container 12, wherein the retaining lugs 40 are arranged at the center of and engaging over the fitted curved transverse cross-members 22 (another form of the retaining lugs is illustrated in FIG. 9).

Figure 3:
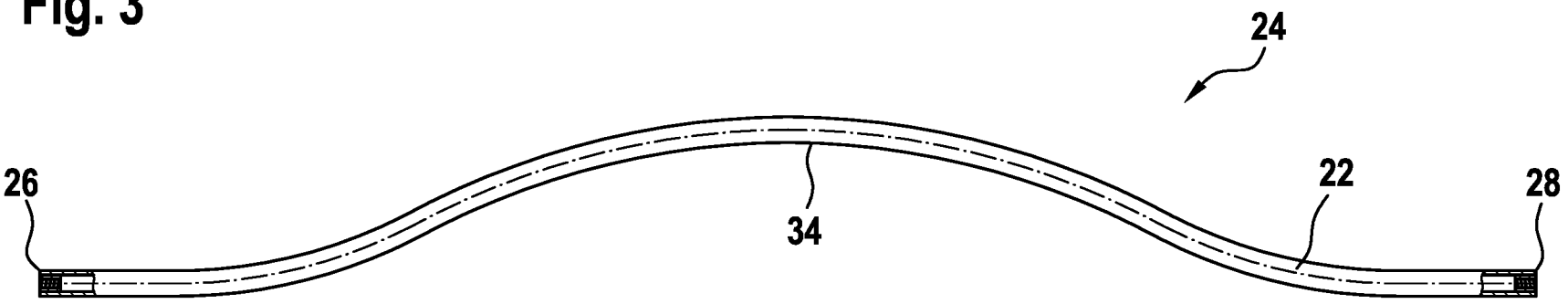
FIG. 3 is a plan view of a transverse cross-member which is configured as a resilient element.

FIG. 3 is a plan view of a curved transverse cross-member 22 which is in the form of a spring element and which has a large radius of curvature of approximately 500 mm. The transverse cross-members may be constructed as a hollow tube having a round or square cross section. In a preferred embodiment, the transverse cross-members 22, 42 have a round tubular profile with a diameter between 16 mm and 24 mm, preferably 20 mm, and a wall thickness between 0.8 mm and 1.2 mm, preferably 0.9 mm. According to another construction type, however, the transverse cross-members 22, 42 may also have a square tubular profile with a side length between 14 mm and 20 mm, preferably 16 mm, and a wall thickness between 0.8 mm and 1.2 mm, preferably 0.9 mm.

Figure 4:
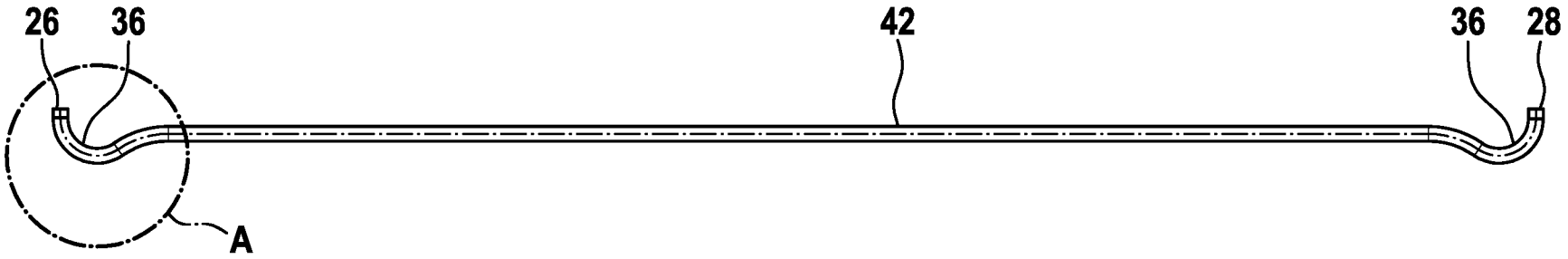
FIG. 4 is a side view of another embodiment of a transverse cross-member.
Figure 5:
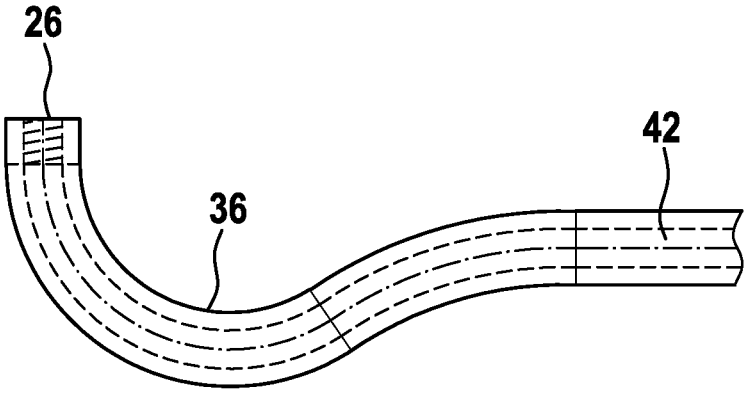
FIG. 5 is an enlarged partial view of the left end region of the transverse cross-member according to FIG. 4.

FIG. 4 is a side view of another embodiment of a transverse cross-member with two curves 42 which have in the end regions thereof—when viewed in the fitted state—a downwardly formed small curve 36 with a comparatively small radius and upwardly directed ends and (as can be seen in detail in FIG. 8) are each screwed with their respective end faces from below against the uppermost circumferential horizontal tubular rod 18. One end of the transverse cross-member with two curves 42 with downwardly formed small curves 36 with a small radius is illustrated as an enlarged partial view in FIG. 5. A threaded nut 30 with an internal thread 44 (for example, M8 or M10) is securely inserted in the open ends of the hollow tubular profile of the transverse cross-member with two curves 42 (see also FIG. 7). The non-releasably inserted threaded nut 30 can simply be pressed in, compressed or welded.

Figure 6:
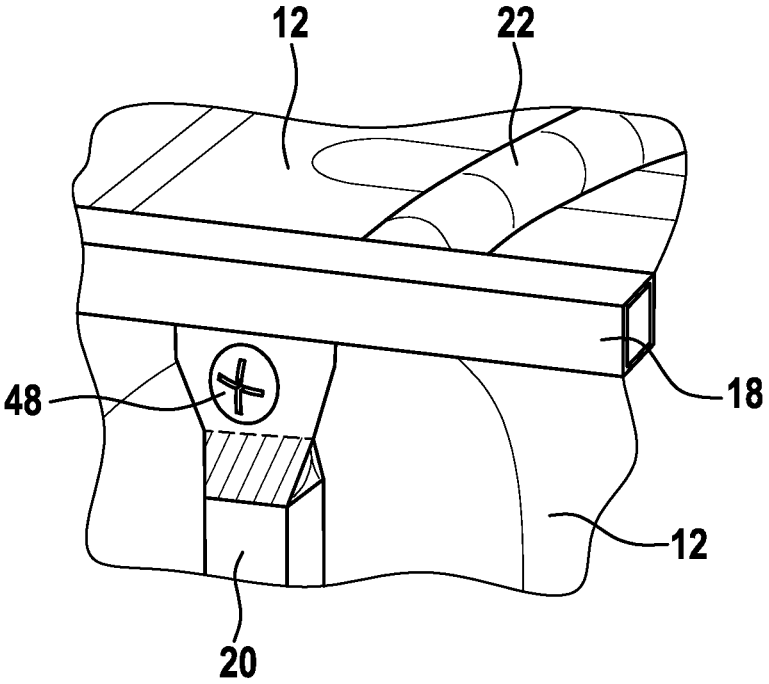
FIG. 6 is an enlarged partial view with a transverse cross-member being connected to the upper region of a tubular grid frame.

One possible fixing method, in which a threaded screw 48 is screwed at the end face into the end of the hollow tubular profile of the transverse cross-member 22 can be seen in FIG. 6. In this case, the transverse cross-member 22 is fixed closely below the uppermost horizontal tubular rod 18 by means of the threaded screw 48 which is screwed from the exterior at the end face—in the horizontal direction—to the upper flattened ends of two mutually opposite vertical tubular rods 20.

Figure 7:
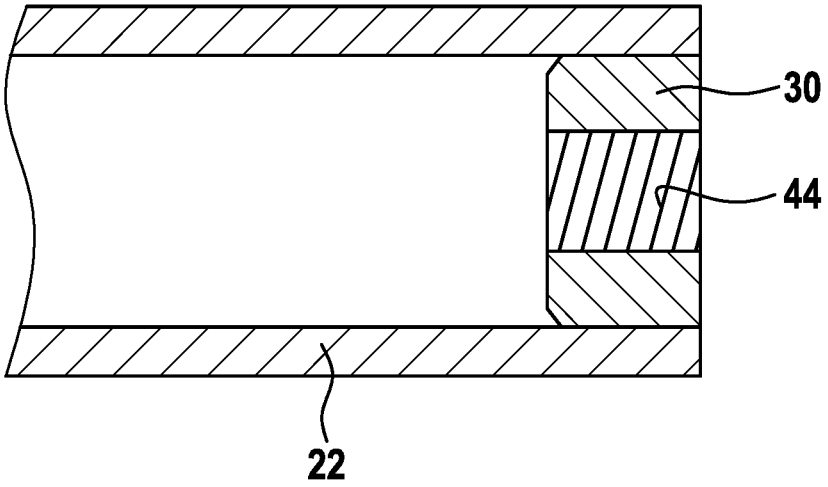
FIG. 7 is an enlarged partial view of the right end region of a transverse cross-member with a threaded nut inserted.

FIG. 7 correspondingly shows the open end of the hollow tubular profile of the transverse cross-member 22 (having only one large curve) with a securely inserted screw nut 30 having an internal thread 44. The transverse cross-member with 2 curves 42 is, as described above, screwed with its end face from below against the uppermost circumferential horizontal tubular rod 18 of the tubular grid frame in a secure but re-releasable manner.

Figure 8:
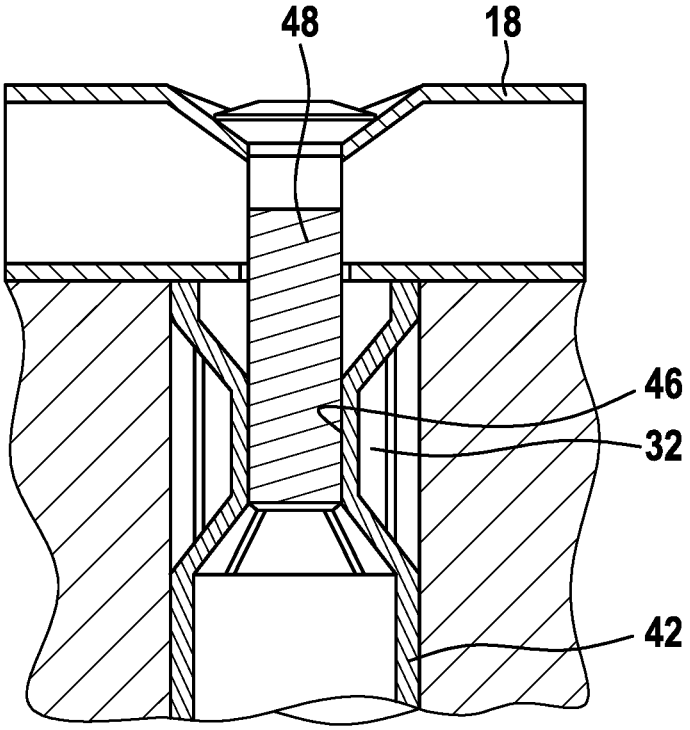
FIG. 8 is an enlarged partial cross sectional view with an end-face screw connection of a transverse cross-member to the upper region of the tubular grid frame.

Another possible method for fixing the transverse cross-member with two curves 42 with an end-face screw connection is shown in FIG. 8 as an enlarged illustration. In this case, the two ends of the transverse cross-members with 2 curves 42 are strongly compressed in the radial direction, wherein a corresponding internal thread 46 is formed directly in the compressed portions 32. In this case, the transverse cross-members with 2 curves 42 with the smaller curves at the end regions thereof are fixed at their end faces from below against the uppermost horizontal tubular rod 18 by means of a threaded screw 48 which is screwed in from above—in the vertical direction. Advantageously, the uppermost horizontal tubular rod 18 is slightly recessed at the top at the bore hole and the threaded screw 48 is configured as a flat-head, countersunk head or raised countersunk screw so that it does not project upwardly. The compressed portions 32 with a correspondingly formed internal thread 46 can naturally also be produced in the case of the transverse cross-member 22 (with only one large curve). The end-face screw connections further have the advantage that the screw tip is located completely in the hollow tubular profile of the transverse cross-members 22, 42 and is covered so that injuries can no longer thereby result, as was often the case with previously conventional open screw connections with a projecting screw tip.

Previously conventional linear cross-members can be screwed directly in the center axis with screws at the end face only with difficulty. When the screws are tightened, the cross-member also rotates and it has to be fixed for assembly. This fixing is dispensed with as a result of the arcuately curved shape of the transverse cross-members.

As previously mentioned, the arcuately curved transverse cross-members 22—in the fitted state—are each guided through a retaining lug 40 which is formed from the upper base 38 of the plastics inner container 12. In another embodiment, the retaining lugs 40 may also be constructed as carrier pins 50 (also referred to as hook lugs) which are open at one side, as shown in FIG. 9. In this instance, the curved transverse cross-members 22 are centrally fixed by central engagement of the carrier pins 50 over the transverse cross embers from the outer side to the inner side, with the carrier pins 50 constructed in a solid manner by means of material thickening.

Figure 10:
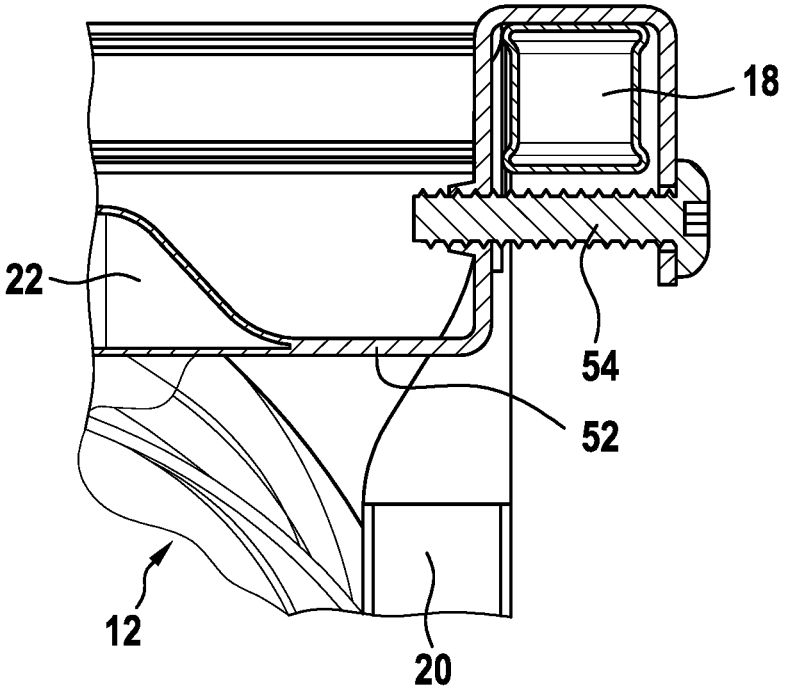

The differently configured versions of the transverse cross-members 22, 42 enable a different configuration of the securing of the two ends of the transverse cross-members 22, 42 to the upper tubular grid frame 14. In addition to the end-face fixings described, the ends 52 of the transverse cross-members 22, 42— in a manner known per se—may also be flattened, placed flat around the uppermost horizontal rod of the tubular grid frame 14 and screwed by means of a threaded screw 54 below the uppermost tubular rods 18, as can be seen in FIG. 10.

In a combined form, the transverse cross-members 22, 42 may be constructed as resilient spring elements also with two smaller curves which are orientated in a vertical plane with smaller radii in comparison and one, two or three smaller curves which are orientated in a horizontal plane with smaller radii in comparison. Such a formation may be advantageous for a torque-neutral construction. The embodiments of the transverse cross-members described and the securing possibilities may in the context of the present invention—as far as technically possible—be combined in a simple manner with each other or exchanged for each other.

Conclusion: As a result of the construction according to the invention of the transverse cross-members 22, 42 as resilient spring elements, in a pallet container 10 in a comparatively simple manner the upper region of the tubular grid frame 14 can be protected against a disadvantageous effect of transport impacts and dynamic impact loads and the operational safety during the handling of filled pallet containers can be increased.

LIST OF REFERENCE NUMERALS

10 Pallet container
12 Plastics inner container
14 Tubular grid frame
16 Base pallet
18 Horizontal tubular rods (14)
20 Vertical tubular rods (14)
22 Transverse cross-member
24 Spring element (22)
26 Fixing location (22)
28 Opposite fixing location (22)
30 Threaded nut (22)
32 Compressed portion (22)
34 Large curve (22)
36 Small curve (22)
38 Upper base (12)
40 Retaining lug (38)
42 Transverse cross-member with 2 curves
44 Internal thread (30)
46 Internal thread (32)
48 Threaded screw (30, 32)
50 Hook lug or carrier pin (38, 12)
52 End of transverse cross-member (22, 42)
54 Threaded screw (22, 42)

The invention claimed is:

1. A pallet container for storing and transporting fluid or flowable filling materials, the pallet container comprising:

a thin-walled, rigid plastics inner container made from thermoplastic plastics material;

a tubular grid frame which tightly surrounds the plastics inner container as a supporting covering and which comprises horizontal and vertical tubular rods which are welded to each other; and a base pallet on which the plastics inner container is positioned and to which the tubular grid frame is securely connected, wherein two rod-shaped transverse cross-members are provided above the plastics inner container, each of the transverse cross-members being fixed at two ends thereof to two opposing side walls of an upper region of the tubular grid frame, wherein each of the two transverse cross-members comprises one or more first curved portions to thereby form a resilient spring element.

2. The pallet container as claimed in claim 1, wherein a length of each of the transverse cross-members is greater than a straight line extending between the two ends of each corresponding transverse.

3. The pallet container as claimed in claim 1, wherein:

each of the transverse cross-members, when attached to the upper region of the tubular grid frame, extends between a first pair of opposing sides of the tubular grid frame, each of the transverse cross-members, when attached to the upper region of the tubular grid frame, is curved outwardly along a horizontal plane from a central point of tubular grid frame, the central point being on the horizontal plane, and toward one of a second pair of opposing sides of the tubular grid frame, and each of the transverse cross-members is positioned flat on a top of the plastics inner container.

4. The pallet container as claimed in claim 1, wherein:

each of the transverse cross-members is attached to the tubular grid frame at a corresponding pair of fixing locations, and a length of each transverse cross-member is between 1% and 5%, greater than a direct distance between the corresponding pair of fixing locations.

5. The pallet container as claimed in claim 1, wherein each of the transverse cross-members is attached to the tubular grid frame at a corresponding pair of fixing locations, a distance between each pair of fixing locations for is approximately 960 mm, and a length each of the transverse cross-members is approximately 993 mm.

6. The pallet container as claimed in claim 1, wherein each of the transverse cross-members has a radius of curvature between 300 mm and 700 mm.

7. The pallet container as claimed in claim 1, wherein each end of each of the transverse cross-members are comprises a compressed portion and an internal thread that is at least partially located in the compressed portions, and the two ends of each of the transverse cross-members is securely screwed the tubular grid frame.

8. The pallet container as claimed in claim 1, wherein each end of each transverse cross-member comprises an internal thread configured to receive a threaded screw.

9. The pallet container as claimed in claim 1, wherein each end of the transverse cross-members comprises an end face that is screwed to an upper region of a vertical tubular rod.

10. The pallet container as claimed in claim 1, wherein:

each of the transverse cross-members comprise a second curve that extends in a vertical direction and has a second radius that is smaller than a first radius of the one or more first curved portions, and the end of each transverse cross-member is attached to the tubular grid frame such that an end face of each end abuts an uppermost circumferential horizontal tubular rod of the tubular grid frame.

11. The pallet container as claimed in claim 1, wherein each of the transverse cross-members has a round tubular profile, a diameter between 16 mm and 24 mm, and a wall thickness between 0.8 mm and 1.2 mm.

12. The pallet container as claimed in claim 1, wherein each of the transverse cross-members has a square tubular profile, a side length between 14 mm and 20 mm, and a wall thickness between 0.8 mm and 1.2 mm.

13. The pallet container as claimed in claim 1, wherein each of the transverse cross-members comprises two or more second curved portions oriented in a horizontal plane, each of the second curved portions having a radius that is smaller than a radius of the one or more first curved portions.

14. The pallet container as claimed in claim 1, wherein each of the transverse cross-members comprises two second curved portions oriented in a vertical plane, each of the second curved portions having a radius that is smaller than a radius of the one or more first curved portions.

15. The pallet container as claimed in claim 1 further comprising one or more retaining lugs extending from the plastics inner container, each of the one or more retaining lugs being configured to at least partially receive one of the transverse cross-members to thereby guide the one of the transverse cross-members.

16. The pallet container as claimed in claim 1, further comprising one or more hook lugs extending from the plastics inner container, each of the one or more hook lugs being configured to at least partially receive one of the transverse cross-members to thereby guide the one of the transverse cross-members.

* * * * *